US010844320B2

(12) United States Patent
Alexander

(10) Patent No.: US 10,844,320 B2
(45) Date of Patent: Nov. 24, 2020

(54) APPARATUSES AND METHODS FOR FAST MANUAL CANDLE WICK SETTING

(71) Applicant: Byron Alexander, Baton Rouge, LA (US)

(72) Inventor: Byron Alexander, Baton Rouge, LA (US)

( * ) Notice: Subject to any disclaimer, the term of this patent is extended or adjusted under 35 U.S.C. 154(b) by 167 days.

(21) Appl. No.: 16/116,865

(22) Filed: Aug. 29, 2018

(65) Prior Publication Data

US 2020/0071636 A1 Mar. 5, 2020

(51) Int. Cl.
*C11C 5/00* (2006.01)
*C11C 5/02* (2006.01)

(52) U.S. Cl.
CPC ..... *C11C 5/006* (2013.01); *C11C 5/008* (2013.01); *C11C 5/02* (2013.01)

(58) Field of Classification Search
CPC . C11C 5/023; C11C 5/006; C11C 5/02; C11C 5/008
See application file for complete search history.

(56) References Cited

U.S. PATENT DOCUMENTS 3,752,433 A * 8/1973 Berman ..... C11C 5/023 249/94
3,917,441 A * 11/1975 Gray ..... C11C 5/006 431/292
2006/0207717 A1* 9/2006 Campbell ..... C11C 5/006 156/293
2007/0062099 A1* 3/2007 Weathersbee ..... C11C 5/004 44/275

* cited by examiner

*Primary Examiner* — Alfred Basichas
(74) *Attorney, Agent, or Firm* — Norton Rose Fulbright US LLP

(57) ABSTRACT

Apparatuses and methods are provided for rapid and user-friendly manual setting of wicks into container candles. The apparatuses of embodiments include a wick setter that includes a proximal portion configured to receive a downward force. The wick setter also includes an elongated shaft coupled to the proximal portion and defining a longitudinal axis. The elongated shaft is configured to translate the downward force from the proximal portion onto a distal portion of the wick setter. The distal portion includes at least one wick tab holder disposed perpendicularly to the longitudinal axis. The wick tab holder includes a loop configured to engage a corresponding wick tab laterally with respect to the corresponding wick tab. The wick tab holder is also configured to apply a holding force onto the corresponding wick tab for holding the corresponding wick tab attached to the wick tab holder.

19 Claims, 4 Drawing Sheets

APPARATUSES AND METHODS FOR FAST MANUAL CANDLE WICK SETTING

TECHNICAL FIELD

The present invention relates to candle wick setters, and more particularly to a candle wick setter with a fast wick setter holder.

BACKGROUND OF THE INVENTION

Candle making has been around for a long time, and has been and is practiced by a variety of people for a variety of purposes, from hobbyist to craftsmen, and from small commercial operations to large commercial enterprises. In every case, however, the process is similar: at least one wick is set onto a base of a container and wax is then poured into the container.

In traditional candle making, setting the wick onto the base of the container generally entails a manual operation. In most cases, the wick is first inserted into a wick tab. For example, FIG. 1 shows wick 110 inserted onto wick tab 120. Wick tab 120 provides support and purchase for the wick so that the wick stays in place when the wax is eventually poured. In this traditional operation, the wick is then set onto the container by manually inserting the wick tab into the container and placing the wick tab onto the base at the appropriate location. Once the wick is set, wax can be poured into the container. However, the manual process of setting the wick can be slow and difficult because it requires manually setting every wick individually onto the container. The process requires high levels of dexterity and hand-eye coordination, and due to the limited space within the container, the process can be unforgiving. Additionally, as the number of wicks per container increases, the manual wick setting process only takes longer and longer. Having to manually set a large number of wicks per container would be a hindrance to any candle maker.

Some solutions have been proposed for addressing the problem with manual wick setting. One existing solution is shown in wick setter 200 of FIG. 2. Wick setter 200 includes tube 210, push handle 220, and tube holder 230. In this solution, the wick is fed into tube 210, along with the wick tab, and tube holder 320 is set onto the container opening. Push handle 230 is then pushed down, which causes the tube to be lowered thereby setting the wick onto the base of the container. However, this solution is awkward, as it requires feeding the wick through the distal end of tube 220, which creates a delay in the manual process that increases as multiple wicks are used.

BRIEF SUMMARY OF THE INVENTION

The present disclosure is directed to apparatuses and methods which provide for quick and user-friendly manual setting of wicks onto container candles. In some aspects of the present disclosure, the wick setter of embodiments may include a proximal portion, a distal portion, and an elongated shaft coupling the proximal portion to the distal portion. In aspects, the distal portion may include at least one wick tab holder. The at least one wick tab holder may be configured to hold a wick tab within the wick tab holder in an aligned position by application of a holding force. The at least one wick tab holder may include an open-loop holder adapted to apply the holding force to the wick tab, without applying any force upon the wick itself. The holding force may include at least one of a magnetic, compressive, pneumatic, adhesive, etc. force. The elongated shaft may couple the distal portion and the proximal portion, and may define a longitudinal axis. The proximal portion may include a handle adapted to accept a downward force in a direction toward the distal portion, and which force is translated via the elongated shaft onto the distal portion.

The wick tab may include an underside which may include an adhesive adapted to attach the wick tab to the base of a container upon the underside making contact with the base of the container. The at least one wick tab holder may be configured to apply an appropriate amount of holding force such that when the wick tab is placed upon the base of a container and the adhesive on the underside of the wick tab makes contact with the base, the adhesive force created between the underside of the wick tab and the base of the container counteracts and overcomes the holding force applied by the wick tab holder upon the wick tab, thereby releasing the wick tab from the wick tab holder and setting the wick onto the container.

In accordance with aspects of the present disclosure, the wick setter of embodiments may operate to set the wick onto the base of a container by holding at least one wick tab, configured to at least partially contain the wick, using the at least one wick tab holder in the distal portion of the wick setter described above. The distal portion of the wick setter may be inserted into the container and may be positioned such that the at least one wick tab holder is aligned to the proper installation location within the base of the container. A downward force may be applied using the handle of the proximal portion, which is translated via the elongated shaft onto the at least one wick tab holder of the distal portion. The application of the downward force upon the handle causes the adhesive on the underside of the at least one wick tab being held by the at least one wick tab holder to attach the wick tab to the base of the container with a particular adhesive force. As noted above, the at least one wick tab holder is configured to apply an appropriate amount of holding force such that particular adhesive force between the at least one wick tab and the base of the container overcomes the holding force. Because the holding force is overcome by the adhesive force, the at least one wick tab is released from the at least one wick tab holder and is thereby set upon the base of the container. The wick setter may be removed from the container and the wick tab at least partially containing the wick remains within the container.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawings, in which.

DETAILED DESCRIPTION OF THE INVENTION

Figure 1:
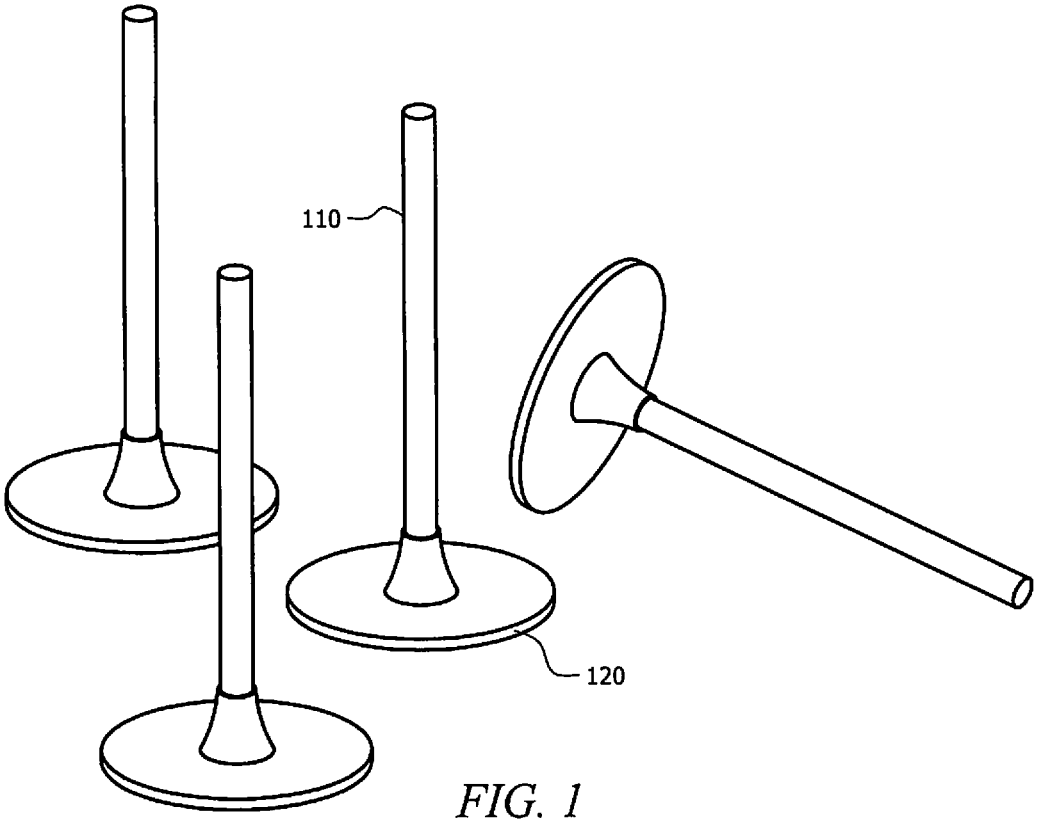
FIG. 1 (Prior Art)
FIG. 1 illustrates a wick tab partially containing a wick and adapted for operation in accordance with embodiments of the present disclosure.
Figure 2:
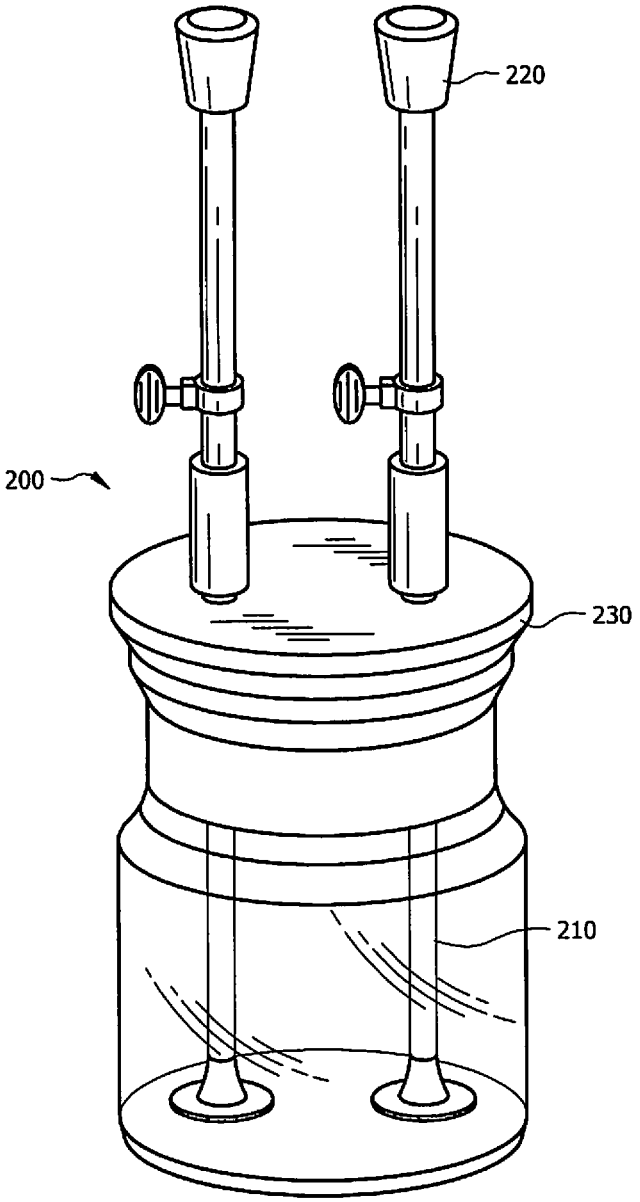
FIG. 2 (Prior Art)
FIG. 2 illustrates an existing wick setter.
Figure 3C:
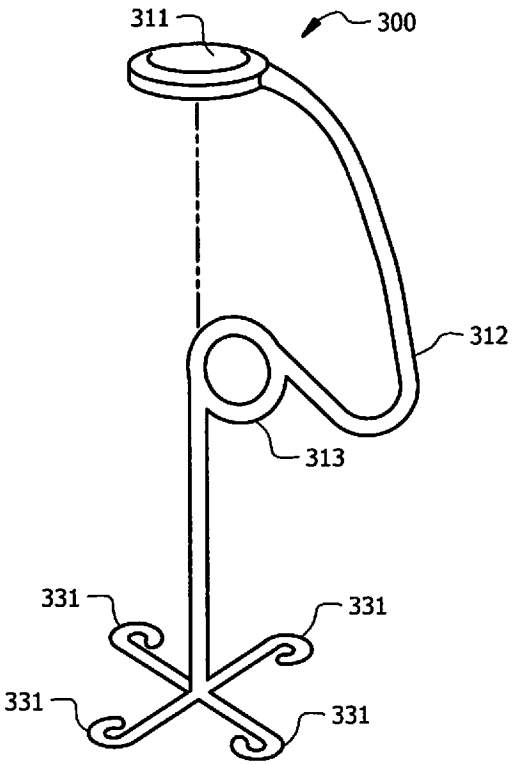
FIGS. 3A-3C illustrate various implementations of a wick setter system in accordance with embodiments of the present disclosure.
Figure 3B:
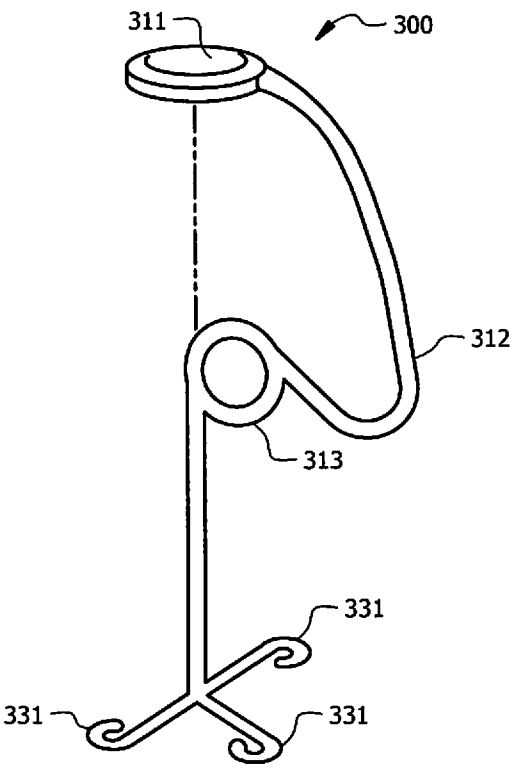
Figure 3A:
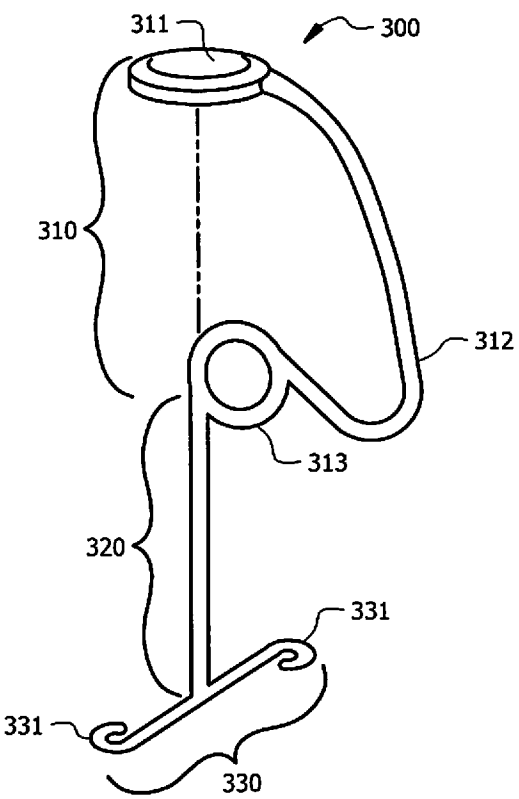

FIG. 3A illustrates an example of a wick setter system in accordance with aspects of the present disclosure. Wick setter 300 of the illustrated embodiment may be configured for quick and user-friendly setting of wicks onto container candles. Wick setter 300 may include proximal portion 310, elongated shaft 320, and distal portion 330. The different components of wick setter 300 cooperatively operate to provide the functions and features discussed herein.

Proximal portion 310 may include handle 311. Handle 311 may be configured to accept an application of a downward force acted upon wick setter 300. For example, in some implementations, handle 311 may comprise a pad, such as a palm or finger pad, adapted to receive contact from a user of wick setter 300. The user may make contact with handle 311 and apply a downward force during operation, as will be described in more detail below. In aspects, handle 311 may be aligned with longitudinal axis 350 defined by the elongated shaft. Alignment of handle 311 with longitudinal axis 350 facilitates translation of the downward force from handle 311 to the elongated shaft, as will be described in more detail below.

It should be noted that although handle 311 is described and illustrated as a pad herein, other configurations of the handle are also envisioned. Some implementations of wick setter 300 may forego handle 311 and instead, may accept the application of the downward force upon the elongated shaft directly. For example, rather than a user applying a downward force upon handle 311, the user may apply the downward force directly upon elongated shaft 320.

In some aspects, proximal portion 310 may also include finger holder 313. Finger holder 313 may be adapted to accept a finger of a user and to provide another stability point for the application of the downward force upon handle 311. In that sense, finger holder 313 may provide stabilization to wick setter 300 during operation so that when the user applies the downward force upon handle 311, wick setter 300 may maintain a stable position as the wick tabs are attached to the base of the container. Although as illustrated finger holder 313 is shown as a loop, in some aspects, finger holder 313 may be configured as a curve, or simply as a point, tab, protrusion, or any other means for providing another point of contact with wick setter 300 for the user.

Proximal portion 310 may include, in some implementations, spring element 312. Spring element 312 may be configured to couple handle 311 to elongated shaft 320 via finger holder 313. Spring element may comprise a curvature in the material laid out between handle 311 and finger holder 313, which creates a spring element. The size of the curvature may be determined by the different factors such as the length of wick setter 300, the materials used, the types of adhesive used for the wick tab, the amount of force required to attach the wick tab to the base of the container, etc. In other aspects, spring element 312 may comprise an actual spring, or may comprise any other mechanism adapted to provide a spring action between handle 311 and elongated shaft 320.

In some aspects, spring element 312 may be configured to control the application and translation of the downward force upon wick setter 300. The amount of spring action provided by spring element 312 may be adapted to absorb the downward force and then release an element of the downward force appropriate for attaching the wick tab to the base of the container, without causing an excessive amount of downward force to be translated to the wick tab holders. Because of the spring action, the downward force is controlled.

Wick setter 300 may also include elongated shaft 320. Elongated shaft 320 may be coupled to proximal portion 310 on one end, and may be coupled to distal portion 330 on the other end. Elongated shaft 320 may define longitudinal axis 350 and may be configured to provide structural support for wick setter 300. Elongated shaft 350 may also be configured to translate the downward force applied upon proximal portion 310 to distal portion 330. In particular, elongated shaft may translate the downward force from handle 311 to wick tab holders 331.

In some aspects, the length of the elongated shaft may be determined by operational requirements. It is noted that too long a length may cause issues with precision during operation and may cause the elongated shaft to be weak and susceptible to breakage and/or bending upon the application of the downward force. On the other hand, too short a length may interfere during operation as the wick tab holders may not be able to make contact with the base of the container. The inventor has observed that acceptable results may be obtained when the elongated shaft is no greater than 20% of the height of the container in which the wick is to be set. Of course, it will be appreciated that no greater than 20% is merely an example of a length for the elongated shaft and should not be construed in any way to be limiting. As such, any other length that meets the above discussed requirements is envisioned and will be considered covered by the present disclosure.

Wick setter 300 may also include distal portion 330. Distal portion 330 may include at least one wick tab holder 331. Wick tab holder 331 may be configured to apply a holding force to a wick tab to be set into a container candle. The application of the holding force may be performed using at least one of magnetic, adhesive, compressive, mechanical, etc. means. For example, wick tab holder 331 may be constructed from a magnetic material, may be embedded with a magnet, may be constructed from a non-magnetic material but coated with a magnetic coating, and/or may be constructed from a non-magnetic material but may then be magnetized. In this example, the force provided by the magnetic force may be sufficient to retain and hold a wick tab within wick tab holder 331. In another example, wick tab holder 331 may include an adhesive adapted to provide an adhesive force sufficient to retain and hold a wick tab within wick tab holder 331. In yet another example, wick tab holder 331 may be configured to provide a compressive force upon a wick tab, e.g., by means of compressing the loop of wick tab holder 331, wherein the compressive force is sufficient to retain and hold a wick tab within wick tab holder 331. In a further example, a mechanical retainer may be included such that the mechanical retainer provides a mechanism for retaining and holding a wick tab within wick tab holder 331. For example, a c-clip, a breakaway washer, etc. may be used to hold the wick tab within wick tab holder 331. The c-clip, breakaway washer, etc., may be adapted so that the c-clip, breakaway washer, etc. breaks away when the wick tab is attached to the base of the container and an upward force is applied to wick setter 300 to remove wick setter 300.

In some aspects, wick tab holder 331 may be configured for rapid engagement with the wick tab. For example, wick tab holder may be configured to have a shape and size that facilitates rapid engagement. In some implementations, wick tab holder 331 may have an open-loop configuration, as shown in FIGS. 3A-C and 4A-B. The open-loop configuration may be adapted as a c-curve, which includes an open portion of wick tab holder's loop. The size of the c-curve may be based on the size and shape of a wick tab, or the portion of the wick tab to make contact with wick tab holder 331. For example, the c-curve configuration of wick tab holder 331 may allow for fast engagement by merely engaging the wick tab through the opening of the c-curve. As such, the engagement is fast without the need to feed the wick through the wick tab holder's loop. Once engaged, the holding force provided by wick tab holder 331 retains and holds the wick tab in place.

It should be noted that the above discussion with respect to an open-loop configuration of the wick tab holder is not intended to be limiting to this disclosure in any way. As such, other configurations of wick tab holder 331 are envisioned that may not be open-loop. For example, a closed-loop configuration may also be suitable, where appropriate.

Wick tab holder 331 may also be configured to hold the wick tabs in alignment during setting. By holding the wick tabs in place within the loop of wick tab holder 331, the alignment of the wick tab with respect to wick setter 300, and with respect to the container, is maintained. In some aspects, distal portion 330 may include a plurality of wick tab holders. In these implementations, each wick tab holds an individual wick tab. The wick tabs may be desired to be set in a particular pattern within the container. In this case, the plurality of wick tab holders may be arranged in distal portion 330 such that the arrangement corresponds to the desired pattern within the container. As each wick tab holder 331 of the plurality of wick tab holders is able to retain and hold a corresponding wick tab in alignment, the desired pattern may be achieved within the container in a simple, fast, and user-friendly manner.

In some embodiments, distal portion 330 including wick tab holder 331 may be detachably coupled to elongated shaft 320. In these embodiments, distal portion 330 may be interchangeable between different configurations of wick tab holders. For example, one configuration of distal portion 330 may include two wick tab holders, as shown in FIG. 3A, while another configuration of distal portion 330 may include three wick tab holders, as shown in FIG. 3B, and while yet another configuration of distal portion 330 may include four wick tab holders, as shown in FIG. 3C. As desired by the user, or as necessary due to operational requirements, one configuration of distal portion 330 may be decoupled from elongated shaft 320 and another configuration may be then coupled to elongated shaft 320. In that sense, wick setter 300 may be selectively configured to meet operational needs.

In some aspects, distal portion 330 may be detachably coupled to elongated shaft 320 by means of a fastener. The fastener may be magnetic, friction-based, or a pin, among various options. In some aspects, distal portion 330 may be coupled to elongated shaft 320 by inserting end of distal portion 330 into, or over, the shaft of elongated shaft 320.

In alternative aspects, wick tab holders 331 of distal portion 330 may be removable from distal portion 330. In these aspects, the configuration of distal portion 330 may be modified by attaching or detaching wick tab holders from distal portion 330. For example, while on a two wick tab holder configuration, wick holder 300 may be modified to a four wick tab holder configuration by adding two more wick tab holders to distal portion 330. It is noted that the addition of the two wick tab holders may require relocating the existing two wick tab holders to maintain symmetry and alignment of the wick tab holders in distal portion 330. In some aspects, wick tab holders 331 may be detachably coupled to distal portion 330 by means of a magnetic, adhesive, or mechanical fastener.

The various components of wick setter 300 may be constructed of various materials. For example, the various components of wick setter discussed above may be constructed of metal (e.g., stainless steel, aluminum, etc.), plastic, or other synthetic material, etc. In some aspects, different components may be made of different materials. For example, handle 311 may be made of plastic, while the rest of wick setter 300 may be made of metal. In these cases, the material chosen for a particular component may be determined by operational and/or manufacturing requirements.

What follows is a discussion of exemplary operations with respect to a wick setter implemented in accordance with the present disclosure, with respect to wick setter 300 illustrated in FIGS. 3A-C and 4A-B. It will be appreciated that the operations discussed herein are for illustration purposes and should not be construed as limiting the present disclosure in any way whatsoever.

As noted above, the wick setter of embodiments may be configured for rapid and user-friendly manual setting of a wick onto a base of a container. Exemplary operations may begin by a user determining a desired pattern for arranging at least one wick within a container candle. The user may select a particular configuration for a distal portion of a wick setter that corresponds to the desired arrangement. For example, a user may determine a desired pattern of two wicks in a container candle disposed ninety degrees from each other, as in the two-wick arrangement shown in FIG. 3A. The user may then select the two-wick arrangement illustrated in FIG. 3A.

Figure 4B:
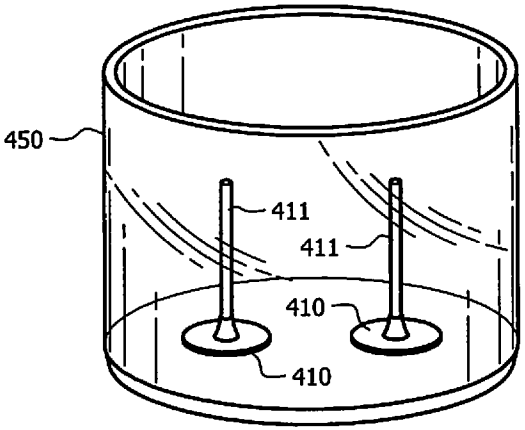
FIGS. 4A and 4B illustrate operations of a wick setter system in accordance with embodiments of the present disclosure.
Figure 4A:
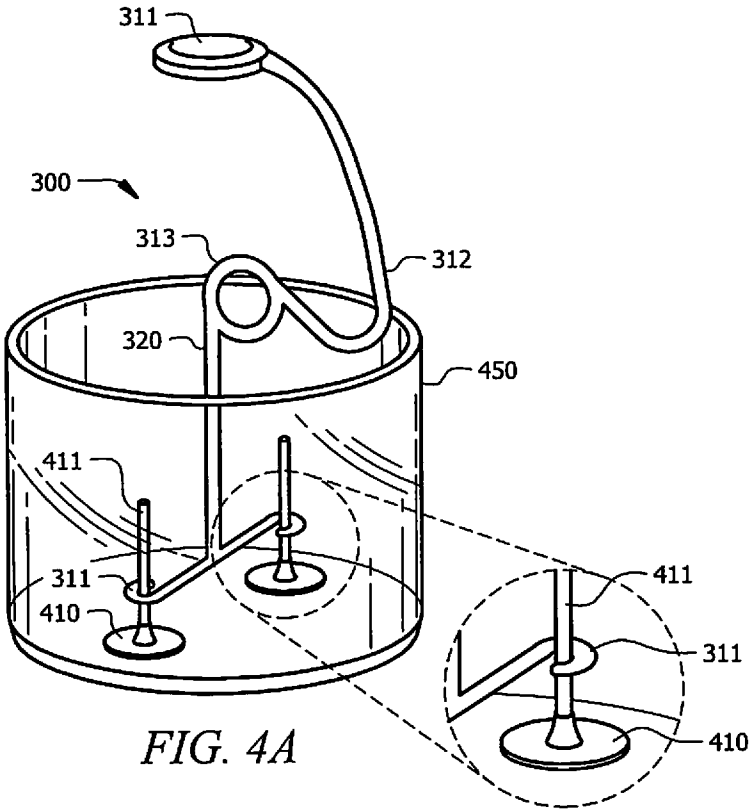

A wick may then be at least partially inserted into each of two wick tabs. An adhesive tab may then be placed upon the underside of each of the two wick tabs, the underside being the side of the wick tabs that will make contact with the base of the container. Each of the two wick tabs may then be engaged with a corresponding one of wick tab holders 331, as shown in FIG. 4A. The engagement may include attaching the wick tab by feeding the wick through the open portion of the c-curve of the wick tab holder, and ensuring that the holding force provided by the wick tab holder is applied to the wick tab. For example, wick tab 410 containing wick 411 may be engaged with wick tab holder 311 by feeding wick tab 410 and/or wick 411 through the open portion of the open loop of wick tab holder 311 and ensuring that the holding force provided by wick tab holder 311 retains, holds, and maintains wick tab 410 in place.

Exemplary operations may continue by guiding wick setter 300 into container 450. The user may insert a finger, such as an index finger, into finger holder 313 and may position another finger, such as a thumb, onto handle pad 311. The natural grasp formed by the position of the hand upon the proximal portion of wick setter 300 may provide additional stability and support during the insertion of wick setter 300 into container 450.

The wick setter 300 may be inserted into container 450 until the underside of wick tabs 410 make contact with the base of container 450. A downward force is then applied onto handle 311, while finger index 313 provides an additional point of stability for ensuring that the downward force does not cause wick setter 300 to lose stability. The downward force may be along a longitudinal axis defined by elongated shaft 320. Additionally, the downward force is controlled by the spring action of spring element 312.

The downward force is translated, via spring element 312 and elongated shaft 320, onto wick tab holders 311. The downward force causes the adhesive on the underside of wick tabs 410 to become attached to the base of container 450. The adhesive is configured such that the adhesive force provided by the adhesion is greater than the holding force provided by wick tab holders 311. Wick setter 300 is then pulled upward, which causes the holding force provided by wick tab holders 311 to be overcome by the adhesive force of the underside of wick tabs 410 and the wick tabs are released from wick tab holders 311 while remaining attached to the base of container 350. Wick setter 300 may then be removed from container 450 and wick tabs 410 at least partially containing wicks 411 remain within container 450, as shown in FIG. 4B.

Although the embodiments of the present disclosure and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed:

1. A wick setter for manually setting at least one wick within a container, said wick setter comprising:

a proximal portion configured to receive a downward force, wherein the proximal portion includes a handle configured to receive the downward force, and wherein the proximal portion further includes a spring element coupled to the handle and configured to control translation of the downward force from the proximal portion onto the distal portion of the wick setter by spring action;

an elongated shaft coupled to the proximal portion and defining a longitudinal axis, the elongated shaft configured to translate the downward force from the proximal portion onto a distal portion of the wick setter; and the distal portion coupled to the elongated shaft, the distal portion including at least one wick tab holder disposed perpendicularly to the longitudinal axis, the at least one wick tab holder including a loop configured to engage a corresponding wick tab, at least partially containing a wick, laterally with respect to the corresponding wick tab, the at least one wick tab holder configured to apply a holding force onto the corresponding wick tab for holding the corresponding wick tab attached to the at least one wick tab holder.

2. The wick setter of claim 1, wherein the proximal portion further includes a finger holder configured to provide an additional point of stability for the wick setter.

3. The wick setter of claim 1, wherein a length of the elongated shaft is based on a percentage of a height of the container.

4. The wick setter of claim 1, wherein the loop of the at least one wick tab holder is an open loop having an open portion, the open loop of the at least one wick tab holder disposed along a horizontal axis, the open loop configured to engage the corresponding wick tab perpendicularly with respect to the horizontal axis through the open portion of the open loop, such that engagement is performed without the wick at least partially contained in the corresponding wick tab being fed through the open loop in a direction vertical to the open loop.

5. The wick setter of claim 4, wherein the open loop includes a c-curve, the size of the c-curve based on the size and shape of one of the corresponding wick tab and the wick at least partially contained in the corresponding wick tab.

6. The wick setter of claim 1, wherein the configuration of the at least one wick tab holder for applying the holding force includes configuration of the at least one wick tab holder for applying one or more of a magnetic force, an adhesive force, a compressive force, and a mechanical force.

7. The wick setter of claim 6, wherein the applying the holding force includes applying the magnetic force, and wherein applying the magnetic force includes at least one of: constructing the at least one wick tab holder from a magnetic material, embedding at least a portion of magnetic material into the at least one wick tab holder, coating the at least one wick tab holder with a magnetic coating, and magnetizing the at least one wick tab holder.

8. The wick setter of claim 6, wherein the applying the holding force includes applying the adhesive force, and wherein applying the adhesive force includes using an adhesive on the at least one wick tab holder adapted to provide the holding force sufficient for holding the corresponding wick tab attached to the at least one wick tab holder.

9. The wick setter of claim 6, wherein the applying the holding force includes applying the compressive force, and wherein applying the compressive force includes compressing the loop of the at least one wick tab holder, wherein the compressive force is sufficient for holding the corresponding wick tab attached to the at least one wick tab holder.

10. The wick setter of claim 6, wherein the applying the holding force includes applying the mechanical force, and wherein applying the mechanical force includes using a mechanical retainer adapted to break away upon application of an upward force upon the wick setter, wherein the compressive force is sufficient for holding the corresponding wick tab attached to the at least one wick tab holder.

11. The wick setter of claim 1, wherein an underside of the corresponding wick tab includes a layer of adhesive and is configured to contact a base of the container, wherein the downward force causes the layer of adhesive on the underside of the corresponding wick tab to attach the corresponding wick tab to the base of the container with an adhesive force greater than the holding force.

12. The wick setter of claim 11, wherein the wick setter is further configured to receive an upward force, wherein the upward force causes the adhesive force to overcome the holding force causing the corresponding wick tab to be released from the at least one wick tab holder, and wherein the corresponding wick tab remains attached to the base of the container.

13. The wick setter of claim 1, wherein the distal portion is detachably coupled to the elongated shaft, and further comprising various distal portion configurations configured to be interchangeable, wherein the various configurations are based on one of a number of wick tab holders.

14. A method for manually setting at least one wick within a container, the method comprising:

attaching a corresponding wick tab to at least one wick tab holder of a wick setter, the attaching comprising:

engaging the corresponding wick tab with a loop of the at least one wick tab holder laterally with respect to the corresponding wick tab, the loop of the at least one wick tab holder configured to apply a holding force onto the corresponding wick tab for holding the corresponding wick tab attached to the at least one wick tab holder;

positioning the at least one wick tab holder within the container such that an underside of the corresponding wick tab contacts a base of the container, the underside of the corresponding wick tab including a layer of adhesive;

applying a downward force onto the wick setter, wherein the downward force is translated to the at least one wick tab holder, the downward force causing the layer of adhesive on the underside of the corresponding wick tab to attach the corresponding wick tab to the base of the container with an adhesive force greater than the holding force; and applying an upward force onto the wick setter, wherein the upward force causes the adhesive force to overcome the holding force causing the corresponding wick tab to be released from the at least one wick tab holder, wherein the corresponding wick tab remains attached to the base of the container.

15. The method of claim 14, wherein the loop of the at least one wick tab holder is an open loop having an open portion, the open loop of the at least one wick tab holder disposed along a horizontal axis, the open loop configured to engage the corresponding wick tab perpendicularly with respect to the horizontal axis through the open portion of the open loop, such that engagement is performed without the wick at least partially contained in the corresponding wick tab being fed through the open loop in a direction vertical to the open loop.

16. The method of claim 14, wherein the configuration of the at least one wick tab holder for applying the holding force includes configuration of the at least one wick tab holder for applying one or more of a magnetic force, an adhesive force, a compressive force, and a mechanical force.

17. The method of claim 16, wherein the applying the holding force includes applying the magnetic force, and wherein applying the magnetic force includes at least one of: constructing the at least one wick tab holder from a magnetic material, embedding at least a portion of magnetic material into the at least one wick tab holder, coating the at least one wick tab holder with a magnetic coating, and magnetizing the at least one wick tab holder.

18. An apparatus for rapid engagement with a wick tab, the apparatus comprising:

at least one wick tab holder including an open loop having an open portion, the open loop of the at least one wick tab holder disposed along a horizontal axis, wherein the open portion of the open loop is at least partially closed in a horizontal plane and open in a vertical plane, the open loop configured to engage a corresponding wick tab perpendicularly with respect to the horizontal axis through the open portion of the open loop, such that engagement is performed without a wick at least partially contained in the corresponding wick tab being fed through the open loop in a direction vertical to the open loop, the at least one wick tab holder configured to apply a holding force onto the corresponding wick tab for holding the corresponding wick tab attached to the at least one wick tab holder.

19. The apparatus of claim 18, wherein the wick tab holder is configured to break away from the at least one wick tab in response to an upward force.

* * * * *